US005652969A

United States Patent [19]

Taylor

[11] Patent Number: 5,652,969

[45] Date of Patent: Aug. 5, 1997

[54] FLUSH APPARATUS FOR USE WITH TOILET ODOR VENTING APPARATUS

[76] Inventor: Raymond J. Taylor, 10714 E. Burgess Ct., Sun Lakes, Ariz. 85248

[21] Appl. No.: 537,149

[22] Filed: Aug. 25, 1995

Related U.S. Application Data

[63] Continuation-in-part of Ser. No. 312,556, Sep. 26, 1994, Pat. No. 5,519,899.

[51] Int. Cl.[6] ..... E03D 3/10

[52] U.S. Cl. ..... 4/359; 4/354; 4/213

[58] Field of Search ..... 4/354–362, 213

[56] References Cited

U.S. PATENT DOCUMENTS 3,677,294 7/1972 Gibbs et al. ..... 4/354 X 3,817,279 6/1974 Larson ..... 4/360 X 3,820,171 6/1974 Larson ..... 4/360

*Primary Examiner*—Robert M. Fetsuga

*Attorney, Agent, or Firm*—Richard G. Harrer; Charles E. Cates

[57] ABSTRACT

A flushing apparatus for controlling water flow in a toilet flushing system. The flushing system includes a pressure tank and differential-pressure type flush valve that opens when accumulated fluid pressure above a piston is vented to atmosphere. The apparatus includes an actuator for venting the flush valve which includes a tubular member that defines an air flow passage through the flushing apparatus. The air flow passage is selectively controlled by a blocking member which slides within and relative to the tubular actuator. The air flow passage can be used to ventilate the corresponding toilet bowl when the system is at rest.

8 Claims, 5 Drawing Sheets

FLUSH APPARATUS FOR USE WITH TOILET ODOR VENTING APPARATUS

This is a continuation in part of U.S. patent appliction Ser. No. 08/312,556, filed Sep. 26, 1994, U.S. Pat. No. 5,519,899, entitled "Toilet Odor Venting Apparatus With Improved Retrofit Capability".

BACKGROUND OF THE INVENTION

The present invention relates to toilet odor venting devices, and is directed more particularly to a toilet odor venting apparatus which can be used with toilets of various sizes, configurations and types without making major modifications to those toilets.

Prior to the present invention there have been a number of attempts to eliminate the unpleasant odors produced in connection with the use of a toilet in a closed room. One class of these attempts, described in U.S. Pat. No. 2,297,935 (Baither), U.S. Pat. No. 2,603,797 (Baither), and U.S. Pat. No. 5,079,782 (Sim), use suction assemblies which draw malodorous air from a toilet bowl, through the holes of the flush ring thereof, and eject them from the room by venting them into the floor drain of the toilet or into a pressure relief pipe located in the wall of the room. While venting devices of this class are at least partially effective, they have the disadvantage that they must either be built into a new toilet at the time of its construction, or be incorporated into an existing toilet by making extensive modifications thereto.

Another class of attempts to eliminate toilet odors includes retrofitable venting devices which draw malodorous air from the toilet through a specially designed toilet seat or through an inlet which fits between the toilet seat and the toilet bowl. Venting devices of this type are described in U.S. Pat. No. 2,728,088 (Gudish), U.S. Pat. No. 4,365,361 (Sanstrom), U.S. Pat. No. 5,161,262 (Quaintance, Sr.) and U.S. Pat. No. 5,231,705 (Ragusa). While venting devices of this type are also at least partially effective, they have the disadvantage that they are cumbersome, visually conspicuous, and spoil the appearance of the toilet.

Still another class of attempts to eliminate toilet odors includes venting devices which are relatively inconspicuous because at least some of their constituent parts are located out of sight in the body or tank of the toilet. Venting devices of this type are described in U.S. Pat. No. 1,972,774 (Hartwell), U.S. Pat. No. 4,103,370 (Arnold) and U.S. Pat. No. 5,201,079 (Sowards). While also somewhat effective, devices of this class have the disadvantage that they are designed to be installed in a toilet at the time of its manufacture. Another disadvantage of odor venting devices of this type is that they bring AC line power in close proximity to the toilet and therefore expose the user thereof to a risk of shock or injury.

Many of the above-discussed venting devices, including the venting device disclosed in my above-cited prior patent application, are specifically intended for use with gravity actuated toilets, i.e., toilets in which the flushing action is produced by the action of gravity on a body of flush water that is stored in a tank at atmospheric pressure. This is particularly true in the case of venting devices, such as those described in the above-cited Baither '935 and Sim patents, and in my above-cited prior patent application, which draw in malodorous air through the openings in the flush ring of the toilet. This is because only toilets of this type include internal passages or conduits that can be used by the venting devices to vent malodorous air without using unsightly external components and conduits, such as those shown in the above-cited Sanstrom and Gudish patents.

More particularly, prior to the present invention, venting devices of the subject type could not be used with toilets of the pressure-actuated type, i.e., toilets in which the flushing action is produced by the release of a body of flush water that is stored under pressure in a pressure tank that is concealed within an outer tank having an appearance similar to the tank of a gravity actuated toilet. This is because toilets of the pressure-actuated type do not have internal passages or ducts through which malodorous air may be drawn from the toilet bowl through the flush ring. Thus, prior to the present invention, the use of venting devices with pressure actuated toilets required the presence of unsightly external components and conduits.

SUMMARY OF THE INVENTION

In accordance with the present invention there is provided a venting system which includes a venting apparatus of the type disclosed in my prior patent application and an improved flushing apparatus or valve that allows that venting apparatus to be used with pressure-actuated toilets.

Generally speaking, the venting apparatus of the invention comprises a low profile, self-contained unit which fits over the tank of a toilet and which establishes through the toilet, in conjunction with the flushing apparatus of the invention, an air flushing path which extends from the bowl of the toilet to the outlet of the venting apparatus. The flow of air through this path is controlled by an improved low-profile suction blower assembly which is capable, during each minute of operation, of drawing from the bowl of the toilet a volume of air that is substantially greater than the volume of the bowl. Because of the great volume of this air, toilet odors are diluted, i.e., dispersed throughout the ambient air of the room in which the toilet is located, so quickly that their concentration does not rise to objectionable (i.e., noticeable) levels. Since the use of the venting system of the invention does not require that odors be transported outside of the room, it may be used without unsightly external ducts or accessories, thereby preserving the original appearance of the toilet and its surroundings.

Because the advantageous features of the venting apparatus of the invention are discussed in detail in my prior application, the discussion thereof will not be repeated in full in the present application. Instead, my prior application is hereby expressly incorporated herein by reference.

Generally speaking, the flushing apparatus or valve of the invention comprises a valve which is similar to the flush valves used in pressure actuated toilets made prior to the present invention in that it is physically interchangeable with such valves and produces a similar flushing action. Unlike prior flush valves, however, the flush valve of the invention allows fluidic communication between the air in the flush ring and the air in the enclosure tank when the valve is closed. As a result, when the flushing apparatus of the invention is used in combination with the venting apparatus of the invention, venting air may be drawn through the toilet in the same manner that has previously been possible only with gravity-actuated toilets. Advantageously, the physical interchangeability of the flush valve of the invention with prior flush valves allows existing pressure actuated toilets to be easily and quickly converted for use with the venting apparatus of the invention, on a retrofit basis, using only the simplest of tools.

In principle, the flush valve of the invention is broadly similar to that of prior flush valves and includes a generally cylindrical air retaining chamber that is sealed within the pressure tank and a flush piston or plunger that is adapted to move upwardly and downwardly within the cylindrical chamber to block or unblock the flow of flush water from the tank to the flush passage of the toilet, depending upon the presence or absence of a sufficient quantity of air within the chamber. In place of the solid actuating member used by known flush valves, however, the flush valve of the invention includes a generally tubular actuating member which controllably blocks or unblocks the release of air in the cylindrical chamber, and at the same time provides a continuous internal passage through which the air in the flush passage of the toilet is maintained in fluidic communication with the air in the enclosure tank when the toilet is not being flushed. This passage through the actuating member allows the flushing apparatus of the invention to cooperate with the venting apparatus of the invention to provide the above-described venting action.

In accordance with the present invention a number of the component parts of the flush valve have been resized or reconfigured to accommodate a tubular actuating member and/or the new air flow paths made necessary thereby. Nevertheless, the fact that the flush valve of the invention is intended to be physically and functionally interchangeable with prior flush valves requires that a certain broad correspondence exist between the main parts of the valve of the invention and those of prior flush valves. Taking into account both the similarities and differences between these main parts, it will be understood that terms such as piston and cylinder which have a well established meaning when used with reference to previously known flush valves will have a different meaning when used with reference to the flush valve of the invention.

In the preferred embodiment, the flush valve of the invention also includes certain additional elements which solve problems that are unique to flush valves which provide a path for the flow of venting air. Principal among these is the possibility that, during flushing, flush water will flow upwardly through the actuating member as well as downwardly into the flushing passage of the toilet. In accordance with the invention, this possibility is eliminated by the introduction of a shaft mounted blocking member which moves upwardly with the flushing piston to close the venting passage when flush water is being discharged from the pressure tank, but which unblocks the venting passage when the piston moves back downwardly at the end of the flush. As a result of this blocking member, the flushing apparatus of the invention is able to cooperate with the venting apparatus of the invention except during those relatively brief periods when the toilet is actually being flushed.

In view of the foregoing it will be seen that the venting system of the invention provides a number of advantages over previously known toilet odor venting devices. Firstly, it is highly effective in flushing malodorous air out of the toilet and dispersing and diluting it so quickly that its concentration does not rise to objectionable levels. Secondly, it has a shape and size that allows it to blend inconspicuously into the original lines of the toilet. Thirdly, it may be installed quickly and easily, without major modifications to the toilet or the room in which it is used. Fourthly, it is easy to use and maintain and presents no risk of shock or injury.

DESCRIPTION OF THE DRAWINGS

Other objects and advantages of the invention will be apparent from the following drawings in which.

DESCRIPTION OF THE PREFERRED EMBODIMENTS

Figure 1:
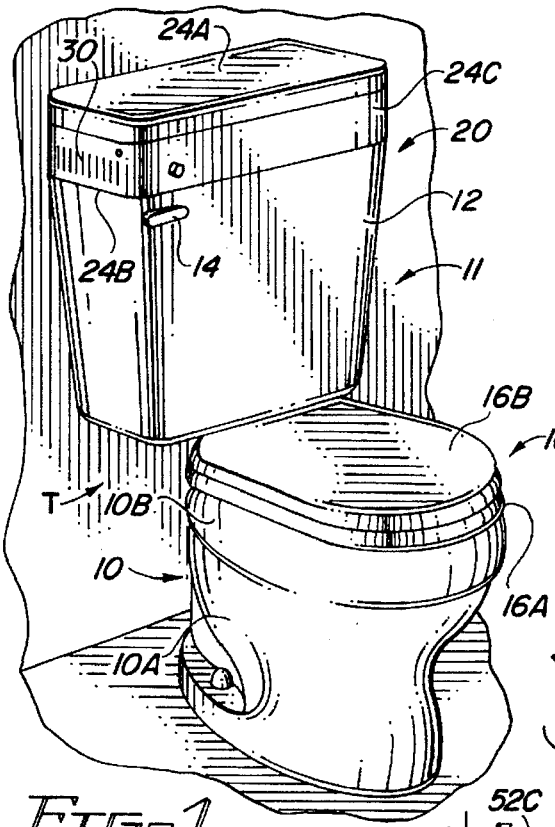
FIG. 1 is an oblique view of a gravity actuated toilet which has been equipped with the venting apparatus of the invention.

Referring to FIG. 1 there is shown in an oblique exterior view of a conventional gravity actuated toilet T which has been equipped with a venting apparatus constructed in accordance with the present invention. Toilet T includes a bowl 10 having a lower, water-filled section 10A and an upper, air-filled section which includes a flush ring 10B of a conventional type, such as that shown in the previously mentioned Baither or Sims patents. Toilet T also includes a tank assembly 11 which here takes the form of a water filled gravity actuated tank 12 for supplying flush water to bowl section 10A and flush ring 10B under the control of a flushing handle 14. Finally, toilet T includes a seat assembly 16, including a hinged annular seat 16A and a hinged seat cover 16B. Because these parts of toilet T are conventional and operate in a conventional manner, neither they nor their operation will be described in detail herein.

Figure 3:
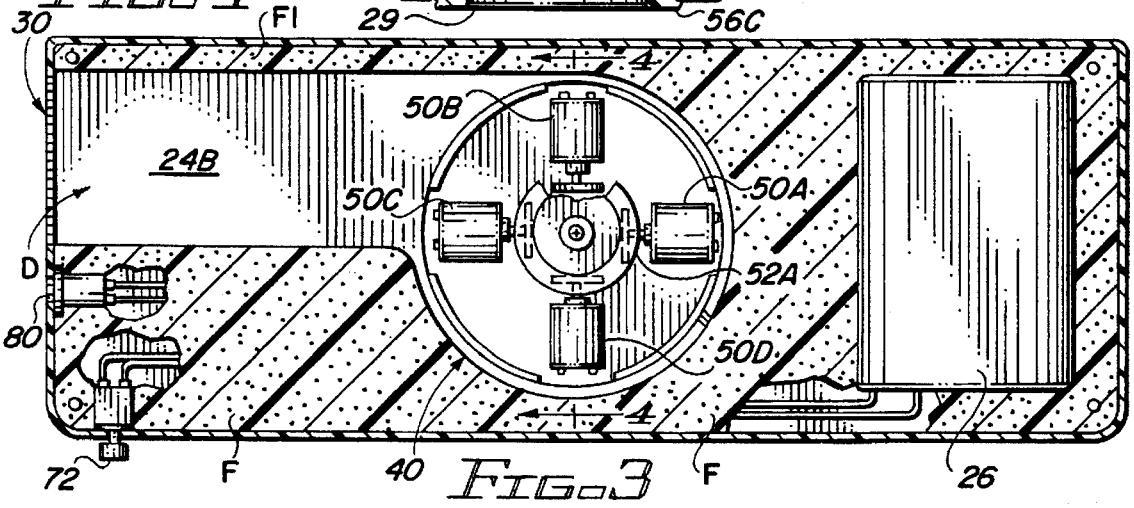
FIG. 3 is a plan view of the venting apparatus shown with its upper cover removed.
Figures 2, 8:
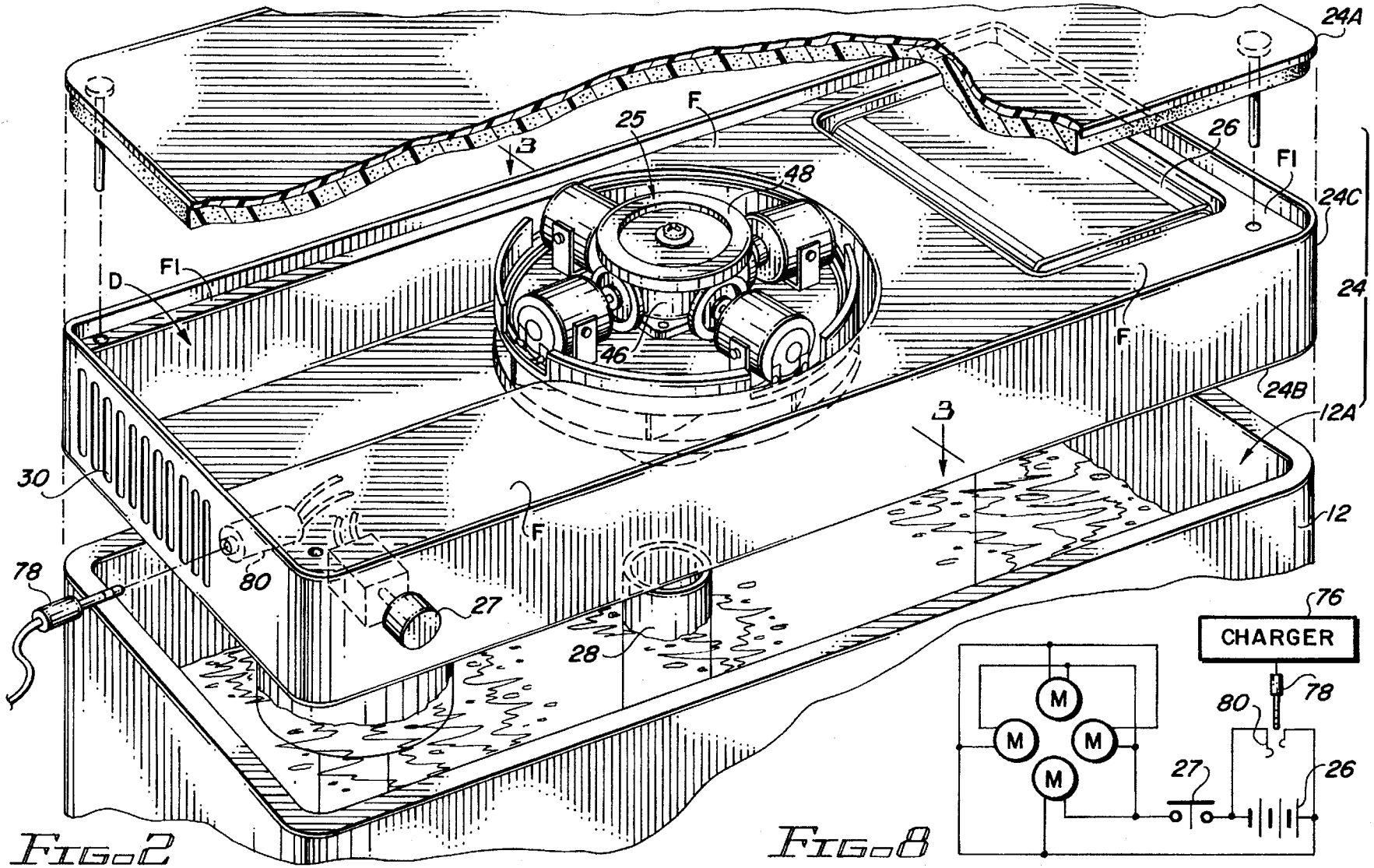
FIG. 2 is an oblique, partially cut-away exploded view of the venting apparatus of the invention and the adjacent portion of the toilet with which it is used.
FIG. 8 is a schematic diagram of the circuitry of the venting apparatus of the invention.

In accordance with the present invention, toilet T of FIG. 1 is equipped with a venting apparatus 20 that includes a housing 24 which fits over the top of tank 12 in place of the usual tank cover. As is best shown in FIGS. 2 and 3, venting apparatus 20 also includes a suction blower assembly 25, a battery 26, and a switch 27 for controllably connecting battery 26 in driving relationship to suction blower assembly 25. In the preferred embodiment suction blower assembly 25 and battery 26 are located within respective openings or pockets which are formed in a body of a suitable fill material F, such as styrofoam, that fills predetermined parts of housing 24 and serves to deaden the sound produced during the operation of venting apparatus 20. Fill body F may also be used to define a shelf for supporting the cover of housing 24 and an outlet duct D that channels air from suction blower 25 to the outlet of housing 24, although the presence of such a duct is not essential to the practice of the present invention.

As shown in FIG. 2, housing 24 includes a top plate or cover 24A, a bottom plate 24B and side plates 24C. Top plate 24A is preferably free of openings and fits within sides 24C, preferably resting on a shoulder F1 formed by the upper surface of fill body F. Bottom plate 24B of housing 24 preferably includes a single inlet opening 24D for an air inlet fitting 29, best shown in FIG. 4. Bottom plate 24B of housing 24 is preferably composed of (or covered by) an elastomeric or semielastomeric material and has a length and width which are at least as large as the length and width of the tank of the largest toilet with which it is used. As will now be explained more fully, this elastomeric quality and these dimensional relationships allow venting apparatus 20 to approximately seal off air-filled upper region 12A of tank 12 and thereby assure that it alone controls the flow of air therethrough.

When positioned as shown in FIG. 1, venting apparatus 20 restricts the path through which air may flow through upper air-filled region 12A of tank 12 to a single path which passes through housing 24. A first part of this path extends from air-filled region 12A through a tank overflow pipe 28, shown in FIG. 2, and the internal passages of the toilet (not shown) to flush ring 10B, the holes of which are open to the ambient air. A second part of this path extends from air-filled region 12A, through an inlet fitting 29 attached to bottom plate 24B of housing 24 of and the interior of housing 24 to an outlet 30 which, in the embodiment of FIG. 2, takes the form of a grill formed in one of the side plates of housing 24. It will therefore be seen that venting apparatus 20 defines and forms a part of an air flushing path which extends from toilet bowl 10 at one end to housing outlet 30 at the other.

As will now be explained more fully, when venting apparatus 20 is in a first, off state, the pressure of the air in all parts of the flushing path is equal to atmospheric pressure and little or no air flows therethrough. When, venting apparatus 20 is in a second, on state, it establishes a substantial negative or suction pressure within air-filled portion 12A of enclosure 12 and a substantial positive or exhaust pressure within housing 24. As a result, in its on state, apparatus 20 acts as a substantial flushing pressure source that is connected in fluidic series with the flushing path and causes air to flow at a high volume rate of flow into bowl 10, through flush ring 10B, and out of housing outlet 30.

During operation, the pressure gradient produced by apparatus 20 is large enough to establish a volume rate of flow of flushing air which assures that malodorous air from bowl 10 is dispersed into and diluted by room air so quickly that it cannot achieve a concentration which is noticeably objectionable. In this way, the venting apparatus of the invention produces its desired effect without the toilet modifications and/or unsightly external ducts required by prior toilet odor venting devices. It will be understood, however, that there is nothing in apparatus 20 that would preclude the use of such an external duct, and that such a duct may be used if a wall opening is conveniently available and a user finds the sight of such a duct acceptable.

While it might be concluded that the objectionable character of malodorous gas in a room cannot be reduced without reducing the total quantity of malodorous gas in that room, this conclusion is not correct. This is because the objectionable quality of a malodorous gas is a subjective matter that is based on the current concentration of such gas in the immediate vicinity of the nose, while the total quantity of malodorous gas is in a room an objective matter based on the integration throughout the volume of the room, of the concentration of that gas as a function of its position therein. In the creation of the present invention it was discovered that malodorous air is much more objectionable when it hovers in concentrated clumps and layers in a given volume of still air (in much the same way that cigarette smoke hovers in clumps and layers) than when it is dispersed more or less uniformly throughout the same volume of moving air. Thus, the apparatus of the invention achieves the apparently paradoxical result of eliminating the objectionable quality of a malodorous gas without elimination the malodorous gas itself.

In accordance with the present invention the above described high pressure gradient and high volume rate of air flow are produced by suction-blower assembly 25. This suction blower assembly preferably has a vertical dimension which is small in relation to the vertical dimension of toilet T. This, in turn, allows the vertical dimension of housing 24 of venting apparatus 20 to be small in relation to that of toilet T. This low vertical profile assures that, when venting apparatus 20 is installed in place of the usual toilet cover, as shown in FIG. 1, it becomes inconspicuous and blends in with the overall lines of toilet T.

Figure 4:
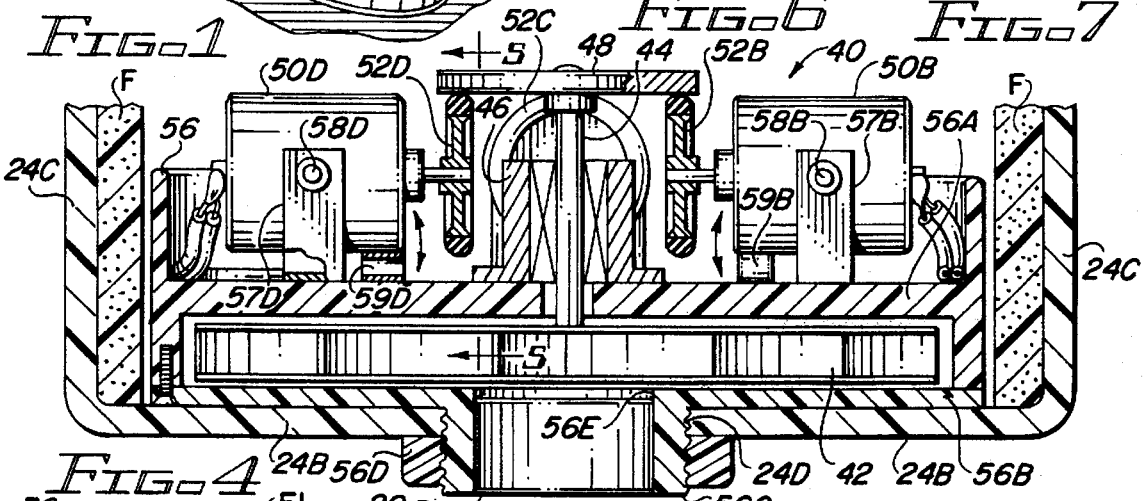
FIG. 4 is a fragmentary cross-sectional view of the venting apparatus taken along the section 4—4 of FIG. 3.

The structure and operation of the preferred embodiment of suction blower assembly 25 will now be described. Referring to FIG. 4, suction blower assembly 25 includes a low profile disk shaped impeller 42 (best shown in FIGS. 9 and 10), an impeller drive shaft 44 journalled for rotation about a vertical axis by a suitable bushing 46, and an impeller drive wheel 48. Suction blower 25 also includes one or more drive motors 50A through 50D which are arranged to drive impeller drive wheel 48 through respective drive wheels 52A through 52D. As is best shown in FIGS. 2 and 4, drive wheels 52A, etc. are journalled for rotation about respective horizontal axes, and drive impeller drive wheel 48 from the underside thereof by means of a frictional engagement therewith. Thus, drive wheels 48 and 52A through 52D together comprise a coupling assembly for coupling the rotary power which motors 50A through 50D produce along respective horizontal axes to impeller 42 to rotate the latter about its vertical axis.

As is best shown in FIG. 4, suction blower assembly 25 is mounted on a mounting assembly 56 that includes an upper central shelf 56A for supporting impeller 42, drive shaft 44, bushing 46, drive motors 50A through 50D and the coupling assembly. Mounting assembly 56 also includes a lower central shelf 56B having a centrally disposed threaded projection 56C and a threaded ring 56D for securing mounting assembly 56 to housing bottom plate 24B via housing inlet hole 24D. Threaded projection 56C also defines the inlet passage 56E through which suction blower 25 draws air from the air-filled region of tank 12.

Because mounting assembly 56 and all of the devices mounted thereof have relatively small vertical dimensions, and because all of these elements are mounted compactly in a manner which minimizes the amount of vertical space they occupy, suction blower assembly 25 as a whole has a vertical dimension which is relatively small. This, in turn, allows the use of a housing having vertical dimension which is small in relation to the vertical dimension of toilet T. As a result, the apparatus of the invention occupies a vertical space which is not substantially greater than the toilet cover it replaces. This, together with horizontal dimensions which approximate those of the tank with which it is used, allows the lines of the apparatus of the invention to blend inconspicuously with those of the toilet.

In spite of the showing of four impeller drive motors in FIGS. 2 and 3, there is no necessary correlation between the result produced by venting apparatus 20 and the number of motors utilized therein. The determining factor in the choice of the number and kind of motors used is whether or not they are able to produce the torque necessary to drive impeller 42 at the high rotational speeds necessary to produce the volume rates of air flow contemplated by the present invention. The reason that four motors were chosen for the embodiment of FIGS. 2, 3 and 4 is that each motor is a type of permanent magnet DC motor which, although it combines the qualities of low cost with a low profile and the ability to operate at high speeds, is able to provide only about one-quarter of the torque necessary to produce the desired volume rate of air flow. It will therefore be understood that, if a single motor having the desired low profile, output torque and high speed capability is available, that single motor may be used in suction blower assembly 25 without departing from the spirit and scope of the present invention.

Figure 9:
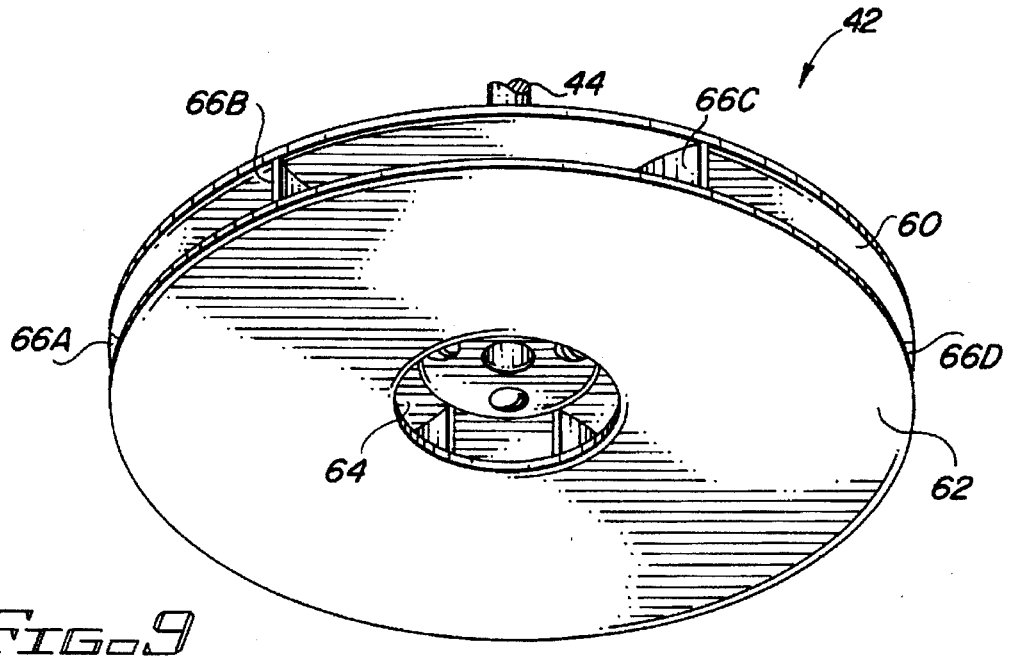
FIG. 9 is an oblique view of the underside of an impeller suitable for use in practicing the present invention.
Figure 10:
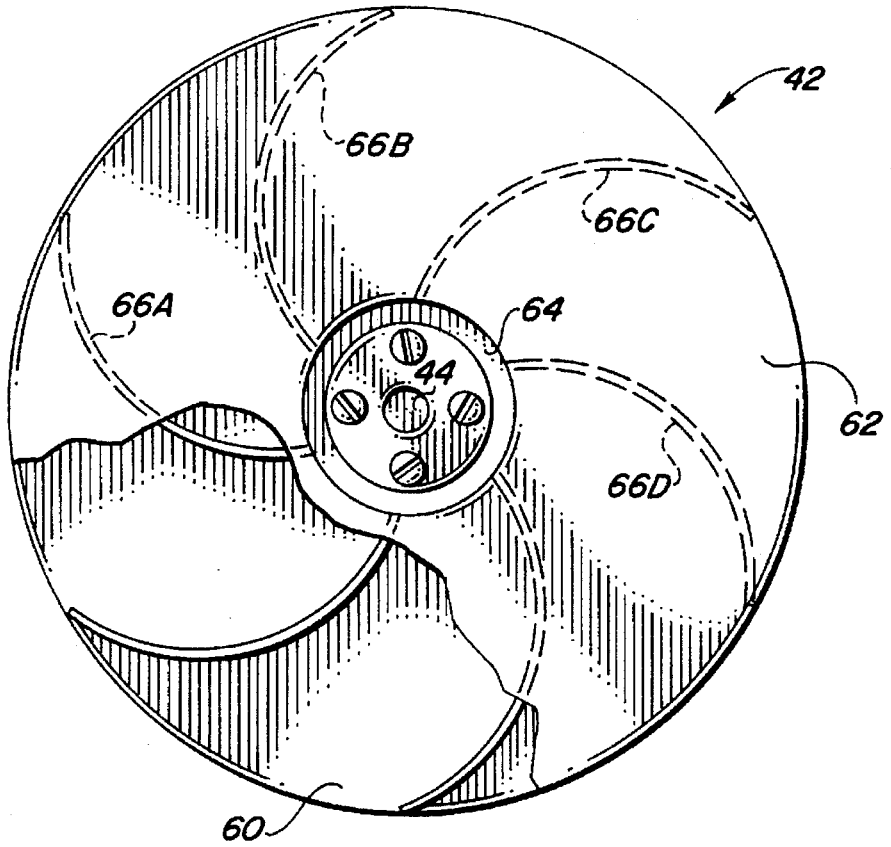
FIG. 10 is a partly cut away plan view of the underside of the impeller of FIG. 9.

Referring to FIGS. 9 and 10 there are shown oblique bottom and partially cutaway bottom views of one low profile impeller which is suitable for use in suction blower assembly 25. This impeller preferably includes an upper plate 60 which is free of openings, a lower plate 62 having a central opening 64, and a plurality of impeller blades 66A, 66B, etc. Each of the latter preferably extends from the outer periphery of plates 60 and 62 toward central opening 64, and each has a spiral like or spiriferous shape. When impeller 42 is rotated at high speed, air is driven radially outwardly by impeller blades 66A, etc. to produce a high pressure at the outer edge thereof and a low pressure within central opening 64 thereof.

In accordance with the present invention, the low pressure within central inlet 64 of impeller 42 is applied to the air-filled region 12A of tank 12 through mounting assembly passage 56E, the upper end of which is located in close proximity to impeller inlet 64. (The latter proximity is desirable because it prevents air within the open interior of housing 24 from being drawn into inlet 64 and thereby forming a part of a useless circulation within housing 24). Since the presence of housing 24 prevents air from flowing into air-filled region 12A of tank 12 except through overflow pipe 28 and flush ring 10B of toilet T, the negative pressure of impeller inlet 64 causes air from the toilet bowl to be sucked forcefully into housing 24. Once the latter air is inside of housing 24, the high pressure at the the periphery of impeller 42 drives it forcefully out of housing 24 through housing outlet 30. Thus, as previously explained, the flushing apparatus of the invention sucks air from bowl 10 of toilet T and expels it at high speed into the ambient air.

The component sizes and ratings contemplated by the present invention will be apparent from the following description of a representative specific example. For a toilet with a bowl having a typical size, e.g., having an air-filled volume of approximately 10 liters, good results have been achieved with an impeller of the type shown in FIGS. 9 and 10 having a diameter of approximately 12½ cm, a central opening of approximately 4½ cm, and a plate separation of approximately 1 cm, which is driven at a rotational speed of approximately 6500 rpm. At this speed, it has been found that the air within the toilet bowl is changed approximately twenty times during each minute that the suction blower assembly of the invention is operating at full speed. Stated differently, during each minute of suction blower operation, the apparatus of the invention exhausts into the ambient air a volume of air approximately twenty times greater than the volume of air in the air-filled portion of the toilet bowl.

The effect of such volume rates of flow on the apparent concentration of malodorous air in the room surrounding the toilet is actually somewhat greater than the numerical values of these volumes indicate. This is because this volume of air is flushed from the toilet at a velocity which hastens its dispersion throughout the air of the room. While the velocity of the air flowing out of housing 24 is difficult to measure accurately, its speed may be approximated on the basis of the calculated velocity of air flowing through overflow pipe 28. Based on approximate measurements of the cross-sectional area of the latter pipe (5 $cm^2$) and the pressure head produced by suction blower 25 (65 to 130 cm of water), the latter rate of flow is estimated at 1500 to 3000 cm (50 to 100 feet) per second. Thus, depending upon the relative cross sectional areas of housing outlet 30 and overflow pipe 28, the velocity of air flowing out of housing 24 may be from 300 to 600 cm (10 to 20 feet) per second.

The results described in the foregoing example have been found to be readily achievable using small, inexpensive 12 volt, 11,500 RPM permanent magnet DC motors which are powered from battery 26 that is connected thereto as shown in the circuit of FIG. 8, all components shown in the latter circuit being labeled with the same numbers used to identify the corresponding elements in FIGS. 1 through 4. In the circuit of FIG. 8, switch 27 is preferably a push button switch of the type which closes and stays closed when pushed a first time, and opens and stays open when pushed a second time. Battery 26 is preferably of the rechargeable type having a rating of, for example, 8 ampere-hours, and may be recharged by a charger 76, of the type commonly used to power hand-held calculators, through a conventional male DC connector 78 which plugs into a matching female connector 80 mounted in housing 24. It will be understood that most or all of the connecting wires of the circuit of FIG. 8 either are not shown in FIGS. 1 through 4 for the sake of clarity or are not visible therein because they are obscured by fill body F.

Given the above described structures and connections, the operation of the apparatus of the invention may be summarized as follows. Between usages of toilet T, switch 27 is in its off state and suction blower 25 produces no suction pressure within air-filled region 12A of tank 12 and no blowing pressure within housing 24. Under this condition all parts of the flushing passage through toilet T and venting apparatus 20 are at atmospheric pressure and little or no air flows therethrough. Before a user uses the toilet he pushes button 27 to turn on suction blower 25, which then begins to produce the pressure gradient which causes flushing air to be drawn from bowl 10 and exhausted through outlet 30 of housing 24. Operation in this mode continues until the user is ready to flush the toilet, at which time he pushes button 27 a second time to turn off suction blower 25. This turn off is important to the proper flushing of solid and liquid waste from the toilet because the suction pressure created by suction blower 25 is powerful enough to restrict the release of flush water to bowl 10 when flush handle 14 is depressed. Once the water flushing action is completed, both the toilet and the apparatus of the invention are restored to their initial condition and are ready to be used again.

From the foregoing it will be seen that the apparatus of the invention operates only intermittently, i.e., only during the time that the time that toilet T is actually being used. Because of this intermittent operation, the energy consumption of venting apparatus 20 is relatively small when averaged over a prolonged period of time. As a result, a rechargeable battery having a rating of as little as 8 ampere-hours should be adequate to operate the, apparatus for weeks or even months, depending upon the frequency with which it is used. When battery 26 does eventually run down, it may be recharged without removing it from housing 24, by plugging charger 76 into an AC outlet and keeping male plug 78 plugged into charging plug 80 until recharging is complete. The fact that charger 76 may provide only a small charging current is not a problem since it is applied continuously over a long period, such as overnight, while discharging current from battery 26 flows only infrequently and for short periods.

While the preferred embodiment of the invention uses a manual on/off switch 27, the invention may also be practiced with an automatic (e.g., seat actuated) on/off switch. The switch may, for example, be actuated by the weight of a user on seat 16A of toilet T, as described in U.S. Pat. No. 4,222,129 (Baker) or U.S. Pat. No. 2,603,797 (Baither), which are hereby incorporated by reference. In addition, either of these types of switches may be used with a built-in timer for automatically turning off the suction blower assembly a predetermined time after it is turned on. Because seat actuated switches and timers are well-known to those skilled in the art, they will not be described in detail herein.

Figure 5:
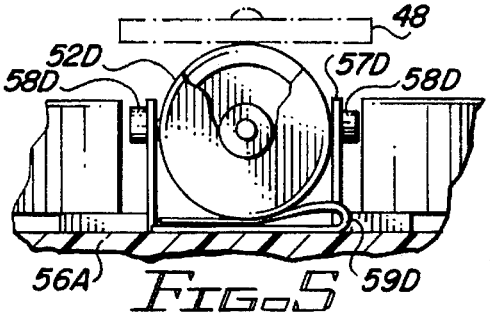
FIG. 5 is a fragmentary end view of the suction blower assembly of the invention taken along the section 5—5 of FIG. 4.

In practicing the present invention it has been discovered that there are certain secondary features which, though not essential to the operation thereof, make its operation more effective and practical. One of these is the inclusion of a horizontally pivotable mounting for each of drive motors 50A through 50D, one example of which is shown in FIG. 5. As shown in FIG. 5 this pivotable mounting includes a generally U-shaped bracket 57D in which motor 50D is pivotally mounted by a pair of pivot elements 58D. Cooperating with this mounting is a low profile spring 59D which tends to push the front end of motor 50D upwardly to assure that a firm frictional driving engagement is maintained between motor drive wheel 52D and impeller drive wheel 48. Because of this firm driving engagement, the coupling assembly of suction blower 25 operates smoothly and steadily without excessive noise or vibration. This driving action may be further improved by including on the driving surfaces of motor drive wheels 52A through 52D and impeller drive wheel 48 elastomeric pads or treads which both cushion the driving engagement and increase the co-efficient of friction therebetween.

Figure 6:
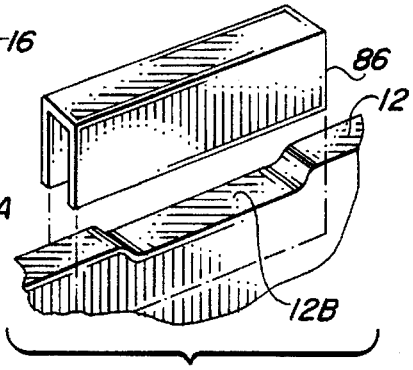
FIGS. 6 and 7 are respective fragmentary oblique and end views of one embodiment of a blocking member which may be used with the venting apparatus of the invention.
Figure 7:
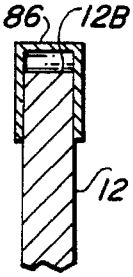

Another secondary feature of the present invention is the use of one or more blocking members for blocking off the openings, such as 12B in FIGS. 6 and 7 which are formed in the tanks of toilets to provide pressure relief during flushing. The blocking of these openings is desirable because, if left unblocked, they allow ambient air to leak into air-filled space 12A of tank 12 (i.e., enter without being drawn through overflow pipe 28) and thereby reduce the desired high suction pressure within tank 12. This reduction in suction pressure is undesirable because it decreases the efficiency with which suction blower 25 can flush air from bowl 10.

One type of blocking member suitable for use in eliminating the above-mentioned leakage is the clip 86 shown in FIGS. 6 and 7. As shown in the latter Fig. this clip is a U-shaped piece of metal or plastic having an opening with a width approximately equal to the thickness of tank 12, and a length and depth comparable to the length and depth of pressure relief opening 12B to be blocked. In addition, clip 86 should be relatively thin so that it does not introduce an appreciable air gap between the upper surface of tank 12 and the bottom plate of apparatus 20. In the event of the non-availability of a clip that meets these conditions for a particular toilet, the desired blocking effect may be achieved with a wad of plumber's putty which is shaped in place to block the pressure relief opening and define an upper surface which can form an approximately sealing engagement with the bottom plate of the apparatus of the invention.

Figure 11:
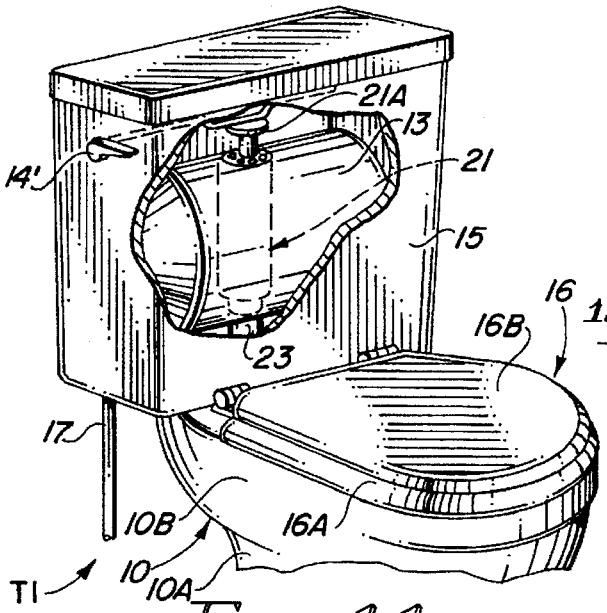
FIG. 11 (PRIOR ART)
FIG. 11 is a partly cutaway oblique view of a conventional toilet of the pressure actuated type.
Figure 12:
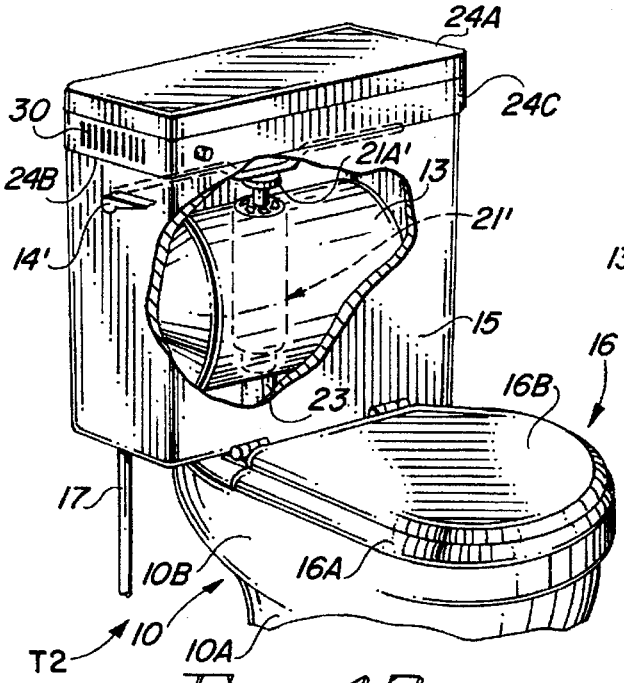
FIG. 12 is a partly cutaway oblique view of a toilet of the pressure actuated type which has been equipped with one embodiment of the venting system of the invention.

Referring to FIGS. 11 and 12 there are shown partly cutaway oblique views of two toilets T1 and T2 of the pressure actuated type, corresponding parts of the toilets of FIGS. 1, 11 and 12 being similarly numbered. As will now be explained more fully, toilets T1 and T2 differ from one another in that the former is a pressure actuated toilet that is not equipped with the venting system of the invention, while the latter is a pressure actuated toilet that is equipped with the venting system of the invention.

Toilets T1 and T2 of FIGS. 11 and 12 are both broadly similar to gravity actuated toilet T of FIG. 1 except that, in the toilets of FIGS. 11 and 12, water-filled tank 12 of FIG. 1 is replaced by a water-filled pressure tank 13 which is enclosed by and supported within an air-filled enclosure tank 15. Because enclosure tank 15 ordinarily contains no water, its function is largely aesthetic, and it may therefore have a wider variety of sizes and shapes than the tanks of gravity actuated toilets.

Referring first to the prior art pressure actuated toilet of FIG. 11, flush water is supplied to tank 13 via an inlet line 17 under the control of a pressure responsive valve (not shown). Flush water is released from this tank via a flushing valve assembly 21 the output of which is connected to the flushing passages of the toilet via a suitable outlet conduit 23. The flushing action of flushing valve or apparatus 21 is ordinarily controlled manually by means of a handle 14' that is coupled to the operating element 21A thereof via a suitable actuating linkage, but may also be controlled automatically as, for example, in response to the movement of seat cover 16B or the removal of a user's weight from seat 16A. Because, except in respects to be discussed more fully presently, the connections and overall operation of pressure-actuated toilets is conventional, these connections and overall operation will not be further described herein.

In accordance with the present invention there is provided a toilet odor venting system which is suitable for use with pressure-actuated toilets of the type shown in FIG. 11, and which may be either incorporated into the structure of toilets at the time of their manufacture or easily and quickly retrofitted to such toilets using only the simplest of tools. As will be explained more fully in connection with FIG. 12, this venting system includes (i) a venting apparatus of the type described earlier in connection with FIGS. 1–10, and (ii) an improved flushing apparatus of the type to be described presently in connection with FIG. 14 and FIG. 14A, which produces the same flushing action as existing flushing apparatuses, but which provides an internal passage for the flow of venting air therethrough when the toilet is not being flushed. In operation, these two parts of the venting system cooperate to produce a venting action similar to that described earlier in connection with gravity-actuated toilets.

Figure 14:
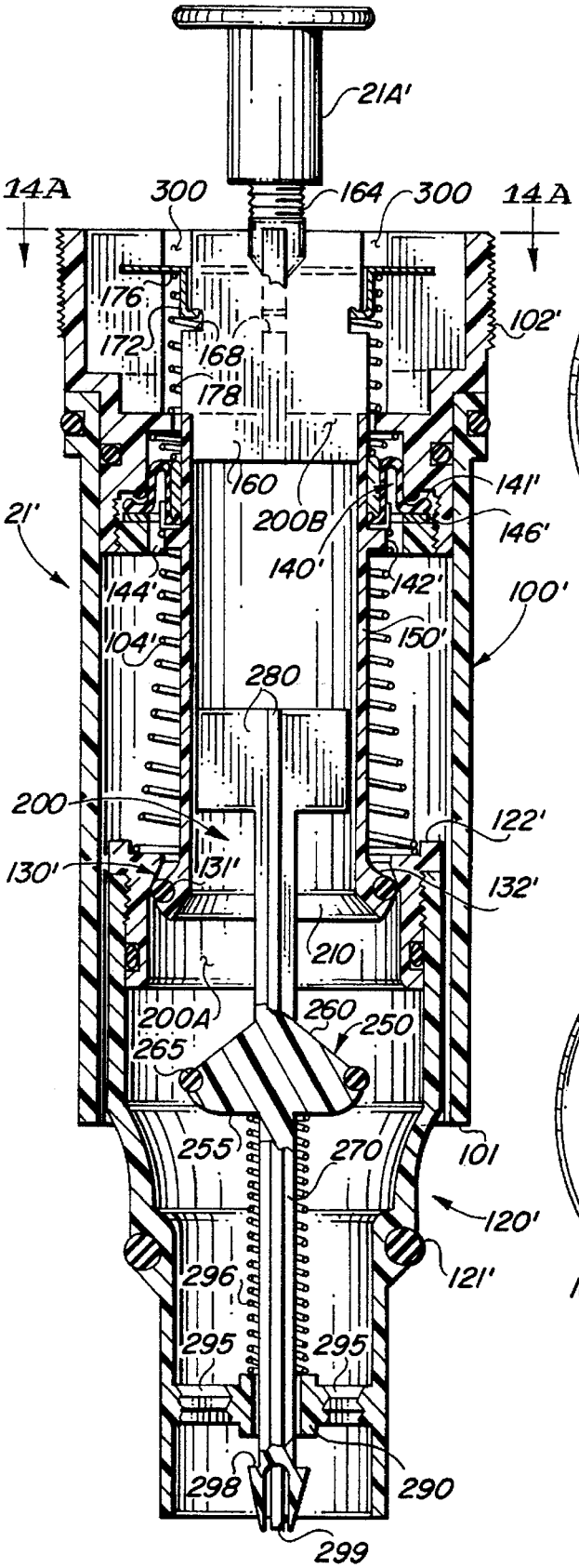
FIG. 14 is a partly cutaway oblique assembly view of one embodiment of the flushing apparatus of the invention.
Figure 14A:
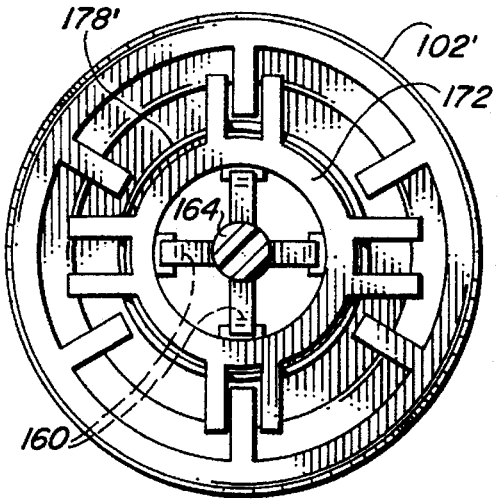
FIG. 14A is a sectional view taken on line 14A—14A of FIG. 14.

In retrofit applications, the venting system is applied to the toilet by replacing the cover of enclosure tank 15 thereof with a venting apparatus 20, such as that shown in FIGS. 1 and 2, and by replacing the original flush valve 21, thereof with a flushing apparatus 21', such as that shown in FIGS. 12, 14 and 14A. Because the latter is physically and functionally interchangeable with the original flush valve, this retrofitting can be accomplished easily and quickly by merely turning off the water, emptying the pressure tank, unscrewing the old apparatus, screwing in the new apparatus, and turning the water back on. As shown in FIG. 12, a toilet retrofitted in this manner has lines that blend more or less into the original lines of toilet T1.

In non-retrofit applications, the venting system of the invention is applied to the toilet by building venting apparatus 20 into the enclosure tank or its cover, and by initially equipping the pressure tank with a flushing apparatus of the type shown in FIGS. 12 and 14. The advantage of such non-retrofit applications is that toilets equipped with the invention in this manner have cleaner "lines" as a result of the closer fit of the built-in venting apparatus to its enclosure tank. Because the appearance of such a toilet is so similar to that shown in FIG. 11, it will not be separately shown herein.

The structure and operation of the venting portion of the venting system of the invention is as described earlier in connection with FIGS. 1–10. Accordingly, a description of this structure and operation will not be repeated in connection with FIGS. 12–14A. The operation of the flushing portion of the venting system of the invention is best understood with reference to the similarities and differences between its structure and operation and the structure and operation of the flushing apparatus used prior to the present invention. Accordingly, there follows a description of the prior art flushing apparatus 21 shown in FIGS. 11, 13 and 13A.

Figure 13:
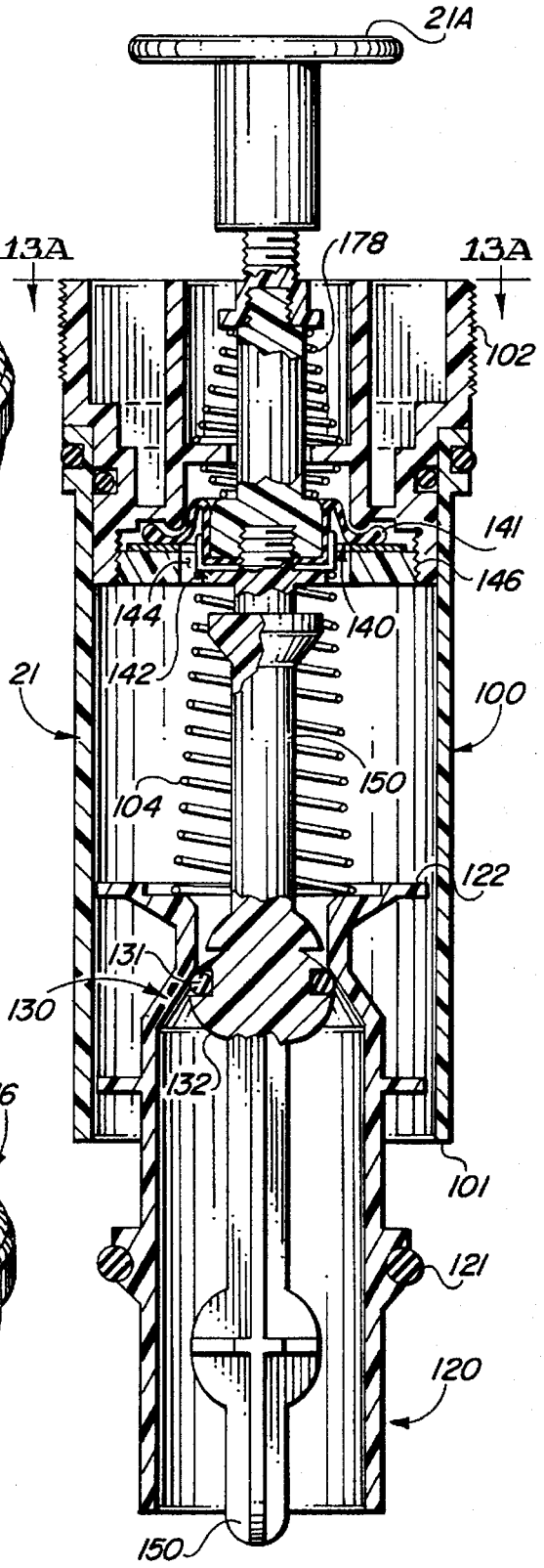
FIG. 13 (PRIOR ART)
FIG. 13 is a partly cutaway oblique assembly view of the prior art flushing apparatus used in the toilet of FIG. 11.
Figure 13A:
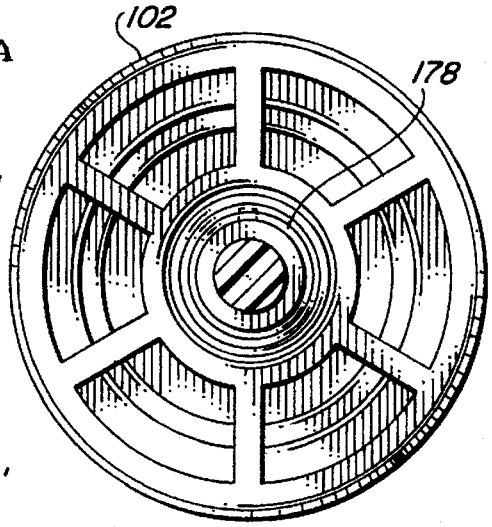
FIG. 13A (PRIOR ART)
FIG. 13A is a sectional view taken on line 13A—13A of FIG. 13.

Referring to FIG. 13 there is shown an enlarged partly cutaway oblique view of the prior art flushing apparatus 21 of FIG. 11. As previously explained flushing apparatus 21 is located within pressure tank 13 and serves to control the release of flush water from that tank into the flushing passages of the toilet. As shown in FIG. 13, flushing apparatus 21 includes an air retention cylinder 100 and a flushing piston 120 which is mounted for upward and downward movement therein.

When the toilet is ready for flushing, a charge of flush water is held within tank 13 under the pressure of a body of air trapped thereabove by the sealing engagement between tank 13 and apparatus 21. A body of air under pressure is also trapped within cylinder 100, this air having become trapped therein as flush water rose above the open lower end 101 thereof when tank 13 refilled after the preceding flush. Because of the presence of this trapped air, piston 120 is unable to move upwardly out of the position shown in FIG. 13. Under this condition an O-ring 121 mounted on piston 120 sealingly engages a valve seat (not shown) at the lower end of tank 13 and thereby prevents flush water from being released therefrom into the toilet.

The above-described ready-to-flush condition may be maintained as long as the air within cylinder 100 is prevented from escaping into the atmosphere. This escape is, in turn, prevented by the action of a lower or main sealing assembly 130 and an upper sealing assembly 140, both of which are supported on a centrally disposed actuating member 150 that is mounted for upward and downward movement within cylinder 100 and piston 120. Of these, lower sealing assembly 130 includes an O-ring 131 which is mounted on a first enlarged cylindrical portion 132 of actuating member 150, and which forms a seal with the upper end plate 122 of piston 120 to prevent trapped air from escaping through the hollow interior of piston 120 into the flushing passage of the toilet. Similarly, upper sealing assembly 140 includes a roughly frustroconical flexible diaphragm 141 which is mounted on a second enlarged cylindrical portion 142 of actuating member 150, and which forms a seal with end cap 102 of cylinder 100 to prevent trapped air from escaping through end cap 102 into enclosure tank 15.

The integrity of the lower seat 130 is maintained at least in part by the action of a spring 104 that is disposed between the upper end plate 122 of piston 120 and a cylindrical projection 142 on actuating member 150. The latter spring tends to push actuating member 150 and piston 120 in opposite directions, thereby producing a sealing force between O-ring 131 and the inner surface of upper end plate 122 of piston 120. Spring 104, in combination with other springs, such as the return spring 178 for actuator end member 21A, serve to restore actuating member 150 to its rest position after the completion of a flushing cycle. Because the sizes, positions and stiffnesses of these springs are well known to those skilled in the art, they will not be described in further detail herein.

When the toilet is flushed as, for example, by the pressing of handle 14', actuating member 150 is pushed downwardly, thereby breaking lower seal 130 and allowing the air within cylinder 100 to escape through the interior of piston 120. As this occurs, the pressurized flush water within tank 13 rushes upwardly into cylinder 100 to take its place. This inrush, in turn, forces piston 120 to rise, unseating O-ring 121 and allowing tank 13 to release flush water into bowl 10 through tank outlet conduit 23 and the internal passages of toilet T1. This release continues until the level of flush water in tank 13 falls below the level of open end 101 of cylinder 100, at which time the water within cylinder 100 drains out and causes piston 120 to descend and reseat O-ring 121. As reseating occurs, tank 13 will begin to refill, via inlet line 17, until a pressure switch (not shown) shuts off the inflow of water when the preset pressure is reached, whereupon the toilet will once again be in its ready-to-flush condition. Because this flushing and refilling operation is well-known it will not be described in further detail herein.

From the foregoing, it will be seen that prior art flushing apparatus 21 does not provide a path for the flow of venting air from the bowl of the toilet to the interior of enclosure tank 15. As a result, prior art toilet T1 of FIG. 11 cannot be used with the venting apparatus of the invention to reduce the objectionable character of toilet odors.

Referring to FIGS. 14 and 14A, there is shown an improved flushing apparatus which can be used with a venting apparatus of the invention. Because of the broad similarity of the flushing apparatuses of FIGS. 13 and 14, the parts of the latter are labelled with the same indicia used for the most nearly similar parts of the former except for the addition of a prime (').

In accordance with one important feature of the present invention, flushing apparatus 21' of FIG. 14 has a size and shape that makes it physically interchangeable with apparatus 21 of FIG. 13. As a result, the flushing apparatus of the invention may be retrofitted to existing pressure actuated toilets without modifying the physical structure of the parts thereof which operate in conjunction therewith.

In accordance with another important feature of the present invention, flushing apparatus 21' of FIG. 14 operates in most respects in a manner so similar to that of flushing apparatus 21 of FIG. 13 that, except for the fact that it establishes an air venting path through the toilet, the operation of apparatus 21' of FIG. 14 is functionally interchangeable with apparatus 21 of FIG. 13. As a result, the flushing apparatus of the invention may be retrofitted to existing pressure actuated toilets without modifying the operation of the parts thereof which operate in conjunction therewith.

In view of these structural and operational similarities, the improved flushing apparatus of FIG. 14 is best understood with reference to the major differences between it and the prior art flushing apparatus of FIG. 13. The first of these major differences is that actuating member 150' of flushing apparatus 21' is tubular rather than solid. More particularly, actuating member 150' defines an interiorly disposed venting passage 200 having an open lower end 200A which is in fluidic communication with the flush passages of the toilet via the interior of piston 120'; and an open upper end 200B which is in fluidic communication with enclosure tank 15 via a specially provided opening through end cap 102'. This actuating passage preferably has a flow area large enough to conduct from flush ring 10A sufficient air to produce the desired odor dispersing effect. This flow area may, for example, be approximately equal to that of overflow pipe 28 (see FIG. 2), although this equality is not critical.

In order to accommodate an actuating member 150' having a diameter large enough to create the above mentioned internal passage, the lower or main seal 130' which O-ring 131' forms between member 150' and piston 120' in the apparatus of FIG. 14 has a larger diameter than the seal 130 which O-ring 131 forms between member 150 and piston 120 in the apparatus of FIG. 13. The function and operation of seal 130' is, however, the same as that described earlier in connection with main seal 130 of the prior art flush valve of FIG. 13. In view of this sameness, the function and operating of main seal 130' of the flushing apparatus of the invention will not be further described herein.

Similarly, the upper seal 141', which prevents air trapped within cylinder 100' from escaping into enclosure tank 15, has a larger inner diameter than corresponding seal 141 of the valve of FIG. 13 in order to accommodate the larger diameter of actuating member 150'. The inner diameter of the threaded ring 146' which clamps the outer edge of seal 141' within cap 102 is also enlarged to accommodate the downward motion of member 150' that is associated with the flushing of the toilet. The function and operation of upper sealing assembly 140' is, however, the same as that described earlier in connection with upper seal 140 of the prior art flush valve of FIG. 13. In view of this sameness, the function and operation of upper sealing assembly 140' of the flushing apparatus of the invention will not be further described herein.

To the end that interior passage 200 of actuating member 150' may be maintained in fluidic communication with the interior of enclosure tank 15 while continuing to be operable by operating button 21A', the upper end of actuating member 150' is provided with a plurality of plate-like vanes 160. These vanes bridge the space between the round upper end of passage 200 and the threaded shaft 164 by which operating button 21A' transmits to member 150' the force necessary to move the latter downward to initiate a flush. These vanes at the same time allow venting air flowing through passage 200 to flow therebetween and into enclosure tank 15 through end cap 102'.

In order to allow venting air flowing upwardly through actuating member 150' to complete its passage through flushing apparatus 21' and enter tank 15, end cap 102' thereof is provided with a central opening 300 which has a diameter somewhat larger than that of member 150'. This central opening distinguishes the end cap of the invention from that used in the prior art valve of FIG. 13, which has a much smaller central opening surrounded by a round flat surface adapted to engage and retain the return spring 178 for actuating member 150 (shown in FIG. 13). It will be understood that end cap 102' of the invention may be molded in the annular shape shown in FIG. 14, or may be constructed by cutting away the interior portion of an end cap of the type used by a prior art flush valve.

Because of its open interior, end cap 102' does not provide a convenient surface for receiving the upper end of the actuator return spring. In order to create such a surface, vanes 160 are provided with a plurality of side openings 168 into which the downwardly extending fingers 172 of a clip or washer 176 may be snapped. The purpose of this clip is to form a horizontally disposed surface for engaging the end of a return spring 178'. In the illustrated embodiment, clip 176 also includes pairs of horizontally disposed fingers which engage the interior vanes of end cap 102' and prevent actuating member 150' from rotating while allowing it to move up and down.

In view of the foregoing, it will be seen that, in spite of its including an actuating member and end cap that define a through passage for the flow of venting air, the flushing apparatus of FIG. 14 fits into exactly the same space as the flushing apparatus shown in FIG. 13. In addition, the flushing apparatus of the invention is actuated by an operating button which has the same position and moves in the same way as the operating button for the flushing apparatus of FIG. 13, and initiates a similar flushing sequence. Thus, as previously stated, the flushing apparatus of the invention is physically and operationally interchangeable with previously known flushing apparatuses.

One final major difference between the flushing apparatus of the invention and the prior art flushing apparatus of FIG. 13 is that the flushing apparatus of the invention includes a blocking assembly 250 which is mounted for upward and downward movement with respect to actuating member 150'. This blocking assembly serves to block off the lower end 200A of the actuating member during the release of flush water, and thereby prevent flush water from being released into tank 15 through passage 200. This, in turn, prevents flush water from accumulating within tank 15, there being no outlet through which tank 15 may drain itself of such water.

In the embodiment of FIG. 14, blocking assembly 250 includes a blocking member 255 having a generally conical blocking surface 260. Blocking member preferably has a size and shape which allows it to abut and block off the lower end 200A of actuating member 150' when the blocking assembly moves upwardly into contact therewith, as will be explained more fully presently. If desired, lower end 200A of actuating member 150' may be shaped to define a seating surface 210 for receiving blocking surface 260, and blocking member 255 may be provided with an O-ring 265 adapted to engage that seating surface.

Blocking member 255 of blocking assembly 250 is preferably supported on a shaft 270 that serves to hold blocking member 255 approximately in alignment with actuating member 150'. Shaft 270 is able to serve these support and alignment functions because its upper and lower ends include or operate in conjunction with guide structures within actuating member 150' and piston 120', respectively. More particularly, the upper end of shaft 270 includes a plurality of guide vanes 280 which fit loosely within passage 200 of actuating member 150'. Similarly, the lower end of shaft 270 fits into a guide bushing 290 that is supported on a plurality of spokes 295 that project inwardly from the inner surface of piston 120'. As a result of these guide structures, it will be seen that blocking assembly 250 is free to move blocking member 255 upwardly and downwardly with respect to the end of actuating member 150'.

When the flushing apparatus is not in its flushing state, blocking assembly 250 assumes the position shown in FIG. 14. Under this condition, venting passage 200 is unblocked and allows venting air to flow therethrough when venting apparatus 20 is turned on. When the flushing apparatus is actuated, however, piston 120' rises rapidly into cylinder 100', causing blocking assembly 250 to rise with it. This action is mediated and buffered to some degree by a suitable spring 296 which is disposed between bushing 290 and the lower surface of blocking member 255. As the upward motion of piston 120' proceeds, blocking member 255 will eventually abut and block off the end of actuating member 150', thereby preventing flush water from flowing therethrough and entering tank 15. This blocking action is enhanced by spring 296 which becomes compressed as piston 120' continues to rise after closing off passage 200.

The above-described blocking condition will continue until the flow of flush water decreases sufficiently to allow piston 120' to move downwardly toward its original position, and thereby pull blocking member 255 away from the end of actuating member 150'. The force of this opening action may be increased by providing at the end of shaft 270 shoulders 298 which are adapted to engage the lower edge of bushing 290 as piston 120' moves away from member 150'. In FIG. 14 these shoulders are located adjacent to an interior slot 299 which allows the end of shaft to compress slightly as the end of shaft 270 is pushed through bushing 290 during the assembly of the apparatus.

From the foregoing, it will be seen that blocking assembly 250 moves upwardly and downwardly within actuating member 150' and piston 120' to block off passage 200 when and only when there is a possibility that flush water may escape through the flushing apparatus into tank 15. At all other times blocking assembly 250 permits the free flow of venting air from the toilet bowl to venting apparatus 20. Thus the flushing apparatus of the invention permits the free flow of venting air through pressure actuated toilets at substantially all times.

While the present invention has been described with reference to a particular embodiment, it will be understood that the true spirit and scope of the present invention should be determined only with reference to the appended claims.

What is claimed is:

1. A flushing apparatus having an open state and a closed state for controllably releasing flush water into a toilet of the type having a pressure tank for storing flush water at an elevated pressure, an enclosure tank for enclosing and supporting said pressure tank, a bowl, a flush ring, and a flushing passage for conducting flush water from the pressure tank to the bowl and the flush ring when said apparatus is in its open state including, in combination:

(a) air retention means for retaining a quantity of air under pressure;

(b) a flush piston adapted to move upwardly and downwardly within said retention means, said flush piston establishing the closed state of said apparatus when said quantity of air is retained by said retention means, and establishing the open state of said apparatus when said quantity of air is released from said retention means;

(c) actuating means for controlling the release of said quantity of air from said retention means;

(d) said actuating means defining an air passage for connecting said flushing passage to the interior of said enclosure tank;

(e) blocking means for preventing flush water from entering said air passage when the apparatus is in its open state;

(f) said blocking means including a blocking member adapted to slide upwardly and downwardly within said actuating means and to block said air passage when said piston moves upwardly within said retention means; and (g) wherein said blocking member is supported on a shaft that is slidably positioned within said actuating means and within said piston.

2. An apparatus as set forth in claim 1 in which said actuating means includes an elongated tube having an upper end that extends into said retention means and a lower end that extends into said piston, and a sealing member for forming an air tight seal between said tube and said piston when said apparatus is in its closed state.

3. An apparatus as set forth in claim 2 in which said actuating means includes an elongated tube having an upper end which extends into said retention means, a lower end that extends into said piston, and a sealing member for forming an air tight seal between the tube and said retention means when the apparatus is in its closed state.

4. An apparatus as set forth in claim 3 further including an operating element for applying a downward force to said actuating means from a point outside of said cylinder, in which said actuating means further includes bridging means for coupling said tube to said operating element without blocking said passage.

5. A flushing apparatus for controllably releasing flush water into a toilet of the type having a pressure tank for storing a charge of flush water at an elevated pressure, an enclosure tank for enclosing and supporting said pressure tank, a bowl, a flush ring, and a flushing passage for conducting flush water from the pressure tank to the bowl and the flush ring including, in combination:

(a) an air retention cylinder disposed within the pressure tank for holding a quantity of air under pressure;

(b) a flush piston adapted to move upwardly and downwardly within said cylinder, said piston having a lower position in which said piston prevents flush water from flowing out of the pressure tank through the flushing passage, and an upper position in which said piston permits flush water to flow out of the pressure tank through the flushing passage;

(c) an actuating member adapted to move upwardly and downwardly within said cylinder, said actuating member having an upper position in which air is prevented from escaping from said cylinder, and a lower position in which air is permitted to escape from said cylinder, said actuating member defining a venting passage for the flow of venting air through said apparatus;

(d) a blocking member adapted to move upwardly and downwardly with respect to said actuating member and to close said venting passage when said flush piston is in its upper position;

(e) said blocking member being mounted on a shaft having a first end slidably positioned with said piston and a second end slidably positioned within said actuating member.

6. An apparatus as set forth in claim 5 in which said actuating member includes an elongated tube having an upper end that extends upwardly into said cylinder and a lower end that extends downwardly into said piston, further including a lower annular sealing member for forming an air tight seal between the outer surface of said tube and said piston.

7. An apparatus as set forth in claim 6 further including an upper annular sealing member for forming an air tight seal between the outer surface of said tube and said cylinder.

8. An apparatus as set forth in claim 7 including an operating element, projecting through said cylinder into said enclosure tank, for applying a downward force to said actuating member, the upper end of said actuating member being so shaped that said operating element does not block the flow of venting air through said actuating member.

* * * * *